US008302223B1

(12) United States Patent
Warner

(10) Patent No.: US 8,302,223 B1
(45) Date of Patent: Nov. 6, 2012

(54) LUGGAGE ATTACHABLE CUSHION DEVICE

(76) Inventor: David W. Warner, Seattle, WA (US)

( * ) Notice: Subject to any disclaimer, the term of this patent is extended or adjusted under 35 U.S.C. 154(b) by 0 days.

(21) Appl. No.: 13/096,087

(22) Filed: Apr. 28, 2011

(51) Int. Cl.
*A47G 9/06* (2006.01)

(52) U.S. Cl. ..... 5/420; 5/417; 5/656; 5/653

(58) Field of Classification Search ..... 190/1, 8, 190/27, 37, 102; 5/417, 420, 942, 413 R, 5/656, 653
See application file for complete search history.

(56) References Cited

U.S. PATENT DOCUMENTS

| | | | | | |
|---|---|---|---|---|---|
| 1,171,678 | A * | 2/1916 | Trotter | 190/110 |
| 3,092,223 | A * | 6/1963 | Martin | 190/1 |
| 3,143,748 | A * | 8/1964 | Manning | 5/420 |
| 4,206,835 | A * | 6/1980 | Shapiro | 190/108 |
| 4,489,815 | A * | 12/1984 | Martinez et al. | 190/1 |
| 4,654,907 | A | 4/1987 | Haugaard | |
| 4,925,064 | A | 5/1990 | Comora | |
| 5,265,292 | A * | 11/1993 | Underell | 5/419 |
| 5,573,155 | A | 11/1996 | Sadler | |
| 5,720,057 | A * | 2/1998 | Duncan | 5/420 |
| 5,779,112 | A | 7/1998 | Krulik | |
| 5,988,465 | A | 11/1999 | Vitale et al. | |
| 7,171,707 | B2 * | 2/2007 | Landay | 5/413 R |
| 2005/0081297 | A1 * | 4/2005 | Woodward et al. | 5/655 |
| 2006/0260046 | A1 * | 11/2006 | Landay | 5/413 R |

* cited by examiner

*Primary Examiner* — William Kelleher

(57) ABSTRACT

The luggage attachable cushion device sections are held together with pliable hinges at the folding lines for wrapping the device around average carry on luggage. Two full-length cloth straps tie sections together lengthwise and wrap around an existing luggage. The strap ends fasten together at the top of the luggage using hook and loop. When unfolded, the device makes a bed, a chair cushion, or can cushion other surfaces as desired. The mat is removably attached to the folding blanket that can be used to further cushion or to cover a user as decided. The device may be especially sized to fit around carry-on luggage so that a user can more conveniently travel.

17 Claims, 9 Drawing Sheets

LUGGAGE ATTACHABLE CUSHION DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Most travelers are at some point met with significant delays. Airport delays provide an excellent example of such, with travelers seeing delays anywhere from several hours to sometimes days. During such delays, seating is typically quickly consumed and travelers are not only inconvenienced by uncomfortable seating but also by having to find a place in the floor, for example, often in great numbers. A major problem therefore becomes comfort in an extended wait, combined with the need for portability of any transported items. The present device provides a unique solution to these problems.

FIELD OF THE INVENTION

The luggage attachable cushion device relates to luggage and to comfort devices, and more especially to a portable cushioned cushion that removably fits around an existing luggage item.

SUMMARY OF THE INVENTION

The general purpose of the luggage attachable cushion device, described subsequently in greater detail, is to provide a luggage attachable cushion device which has many novel features that result in an improved luggage attachable cushion device which is not anticipated, rendered obvious, suggested, or even implied by prior art, either alone or in combination thereof.

News reports and photographs showing travel delays and the inconvenience and discomfort that befell air customers made me want to help in a practical way. People were forced to rest on hard, dirty floors or uncomfortable airport seating. The idea had to be for a compact, easy to carry cushioning surface. Using it had to be very easy, without undue fumbling or juggling of luggage or other travel items. It could not take up precious space in the luggage. It would be a plus if the mat could readily be used on the aircraft seat, leaving the carry-on luggage free of extra bulk and easier to store in the overhead bins. The mat could protect frail luggage from rough handling and colorful covering would make identification easier.

The mat is made up of sections held together with cloth hinges at the folding lines for wrapping it around average carryon luggage. Two full-length cloth straps tie sections together lengthwise and wrap around the luggage. The strap ends fasten together at the top using hook and loop. The top of the luggage is the side with the conventionally used handle for carrying. The mat is firmly held in place this way. Both sides of the free strap ends have hook and loop attached, allowing overlapping either way. The shorter version mat omits a section covering the luggage "top". The straps span across and join together. They may be stiffened with plastic struts sewn in to avoid fumbling with limp straps. The longer version of the mat does have a section covering the top of the luggage, with a slot for access to the handle. Naturally the free ends of the lengthwise straps are shorter.

In addition to the lengthwise straps, there is a strap across the mat near each end, parallel to the hinges; in other words at right angles to the lengthwise straps. One of these straps can be cloth, the other elastic. When the mat is attached these straps wrap around the luggage "horizontally", connecting at each end with hook and loop. The elastic strap may be removable—simply being passed under the lengthwise straps at slots left open by omitting the stitching at those points. This removable elastic strap can be left in place for wrapping around the back of a seat to hold the mat in place for lining the seat; or if the seat is bulky, the strap is removed for attachment to the corresponding cloth strap to fully span around the seat back holding the mat upright in the seat as above. This removable strap can also be used to secure the mat in a "sidesaddle" position on the side of the luggage, where the mat folds compactly.

A small blanket folds within the mat. It has cloth hinges at the folding lines corresponding to the mat hinges. In addition the side edges of the blanket may have a plastic strut, or ribbon sewn in. The strut is crimped or grooved at convenient points so it bends where necessary for flexibility and convenient folding.

These struts should stiffen the blanket and maintain a sufficiently straight edge on the blanket without interfering with machine washing the blanket. The blanket may have a shallow "VI" cut into one end to fit under the chin of the user without blocking vision, mouth, or chin. Hook and loop tabs are spaced along the blanket edges for attaching it to the mat. They must allow attachment on either side of the mat, with the blanket oriented either way. When not in use the blanket provides extra cushioning layer.

The mat is designed to be folded in several ways according to desired use, including folding over at either end to form a headrest.

Filling for the mat can be cotton matting, foam rubber, molded foam, etc. Different filling can be used for sections according to the most likely function served by that section. For instance, cotton stuffing, which breathes better, can be used in the section most likely to form a headrest.

A thick, soft, flexible sheet of rubber or plastic can form a "boot" attached to the bottom of the mat section that contacts the ground when the luggage is set down. This section can be color coded to show that it forms the bottom when the luggage is set on the mat for assembly.

The cloth shell of the mat can provide a large pocket on both sides of the luggage between the lengthwise straps. These pockets should be suitable for storing laptops, magazines, or diapers.

The cloth shell for the mat should be removable for washing. The pads of the mat can be separate or tied together by a cloth web to which they attached by cementing or some other method.

Security measures include a removable plastic locking clamp that pinches two strap-ends together on top of the luggage with the help of hook and loop, securing the mat around the luggage. Another two "locks" can fasten the horizontal straps together at the ends of the luggage. Spring-loaded fingers latch the lock closed. It resembles a clamshell being closed. The locking "fingers" within the device can be varied in number and location to match different keys. The "key" is a plastic device that fits over the locking device and pushes in the "fingers" releasing the jaws of the lock.

In addition there are plastic flaps that cover the zippered openings of the luggage. For appearance sake they can be covered with cloth. The flaps form "wings" on each side of the mat. They can be connected with a cloth web. They are folded underneath the mat when it is in use; and folded inside with the blanket if not needed when the mat is secured to luggage. Or, the flaps and cloth web can be folded compactly and placed in one of the two side pockets.

To attain the device's goals, the luggage attachable cushion device is comprised of sections held together with pliable hinges at the folding lines that may be used in wrapping the device around typical carry on luggage. The pliable hinges may be made of cloth, for example, or other appropriate flexible materials. Two full-length cloth straps tie sections together lengthwise and wrap around the luggage. The strap ends fasten together at the top of the luggage using hook and loop. The luggage top refers to the side with the conventionally used handle for carrying. The mat is firmly and removably held in place with the full length straps. Both sides of the free strap ends have hook and loop attached, allowing selective overlapping. The device may be specifically sized to fit legal carry-on luggage size. A shorter version of the cushioned mat may omit the fifth section that overlaps coverage of the luggage top. This embodiment sees the straps span to join together and secure the device around the luggage. Straps may be stiffened with plastic struts sewn in to avoid fumbling with limp straps. In addition to the full length straps, elastic or non-elastic lateral straps may be provided to encircle the luggage horizontally around what may be termed the luggage ends. The lateral straps may be removably and perpendicularly disposed partially within the full length straps, on the first section and on the fourth section of the mat. The lateral straps may be removable by being passed under the lengthwise straps at slots left open by omitting the stitching at those points. The removable lateral straps can be left in place for wrapping around the back of a seat to hold the mat in place for lining the seat. If encountering an unusually bulky seat, one lateral strap can be removed for attachment to the corresponding lateral strap to fully span around the seat back, thereby holding the mat upright in the seat. The removable lateral straps, whether non-elastic or elastic, can be used to secure the mat in other ways onto a luggage or even other item, as the pliable seams in the mat provide for selectively compact size. Cushioning within the mat may be comprised of various materials including but not limited to cotton, foam, molded foam, or any other suitable cushioning materials. The mat third section, which may be oriented at the base of a luggage, may differ slightly in makeup and even in color to further identify the third section as a point of rest for a luggage item surrounded by the device. Mats may be comprised of removable covers to aid in cleanliness. The mat may also possess one or even two pockets, ideally positioned on the first and second sections and also on the third section, these sections ideally designated for the sides of a luggage item. The pockets may be removable and may also be mesh. The blanket may be secured to the mat with fasteners, which may include hook and loop. The blanket has fasteners on each side that compliment like-oriented fasteners on the mat such that the blanket may be removably secured to either side of the mat. The blanket may be in itself pliable and the blanket may also comprise pliable hinges mirroring those of the mat such that any storage or arrangement of the mat or blanket may be mirrored by the other. Edges of the blanket may further comprise struts that provide additional rigidity. Struts may be intermittent. Struts may also partially comprise joints or flexible points or the like such that the struts may encourage folding along such. These features aid in portability as well as washing machine insertion and also at other times when the blanket requires even further reduced size and flexibility. The blanket may have a V in an area conducive to fit below a user's chin.

Thus has been broadly outlined the more important features of the improved luggage attachable cushion device so that the detailed description thereof that follows may be better understood and in order that the present contribution to the art may be better appreciated.

An object of the luggage attachable cushion device is to provide a portable cushioned mat for comfort.

Another object of the luggage attachable cushion device is to provide a portable cushioned mat that removably fits on an existing luggage item.

A further object of the luggage attachable cushion device is to provide a portable cushioned mat that is suitable for floor use.

An added object of the luggage attachable cushion device is to provide a portable cushioned mat that is suitable for chair use.

And, an object of the luggage attachable cushion device is to provide a portable cushioned mat that is especially beneficial to air travelers.

These together with additional objects, features and advantages of the improved luggage attachable cushion device will be readily apparent to those of ordinary skill in the art upon reading the following detailed description of presently preferred, but nonetheless illustrative, embodiments of the improved luggage attachable cushion device when taken in conjunction with the accompanying drawings.

DETAILED DESCRIPTION OF THE DRAWINGS

With reference now to the drawings, and in particular FIGS. 1 through 8 thereof, the principles and concepts of the luggage attachable cushion device generally designated by the reference number 10 will be described.

Figure 1:
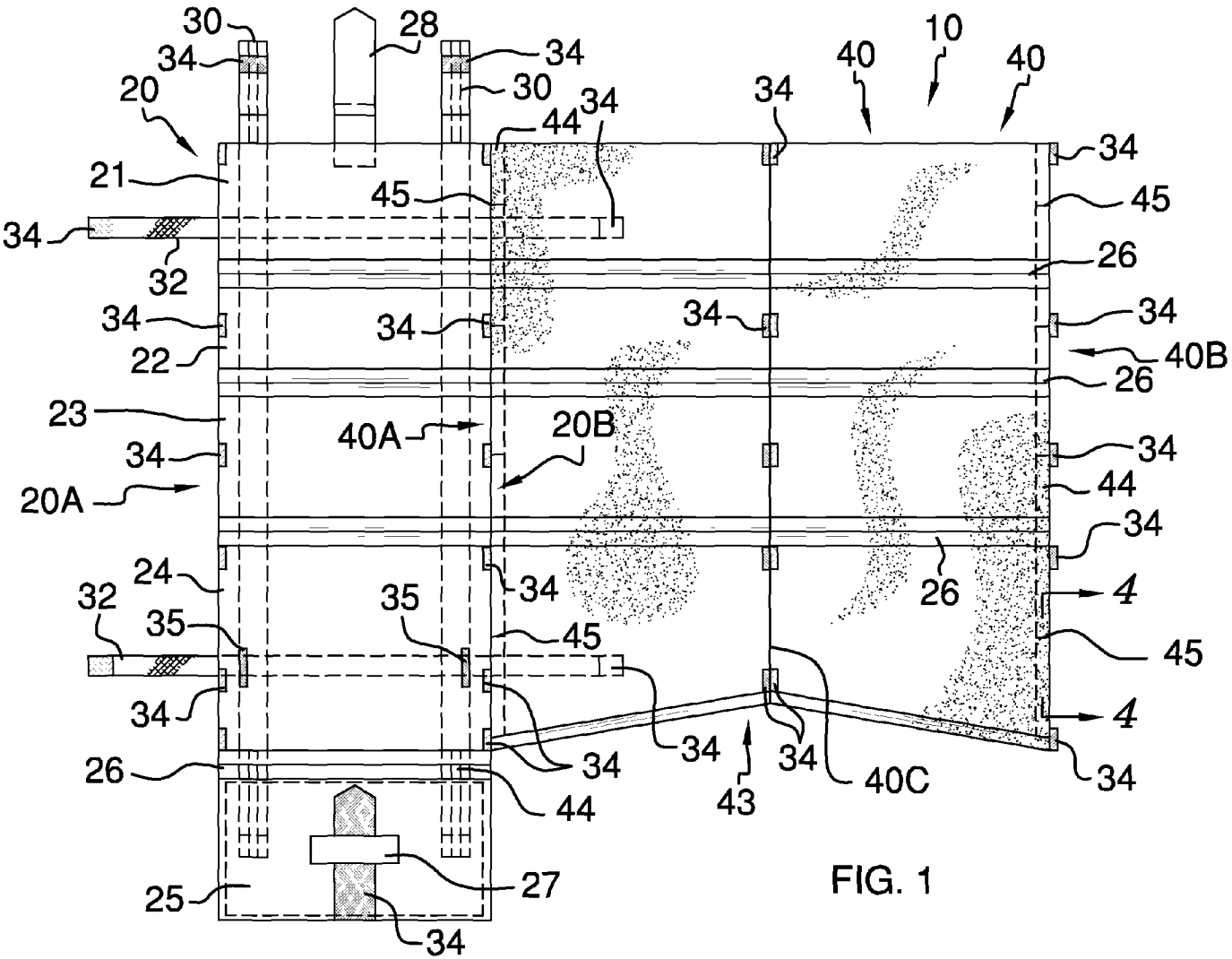
FIG. 1 is a top plan view.

Referring to FIG. 1, the device 10 partially comprises the rectangular cushioned mat 20. The mat 20 further comprises a first side 20A spaced apart from the second side 20B. The mat 20 comprises sequentially affixed rectangular sections joined by pliable hinges 26. The sections comprise a first section 21, a second section 22, a third section 23, a fourth section 24, and a flap section 25.

Figure 2:
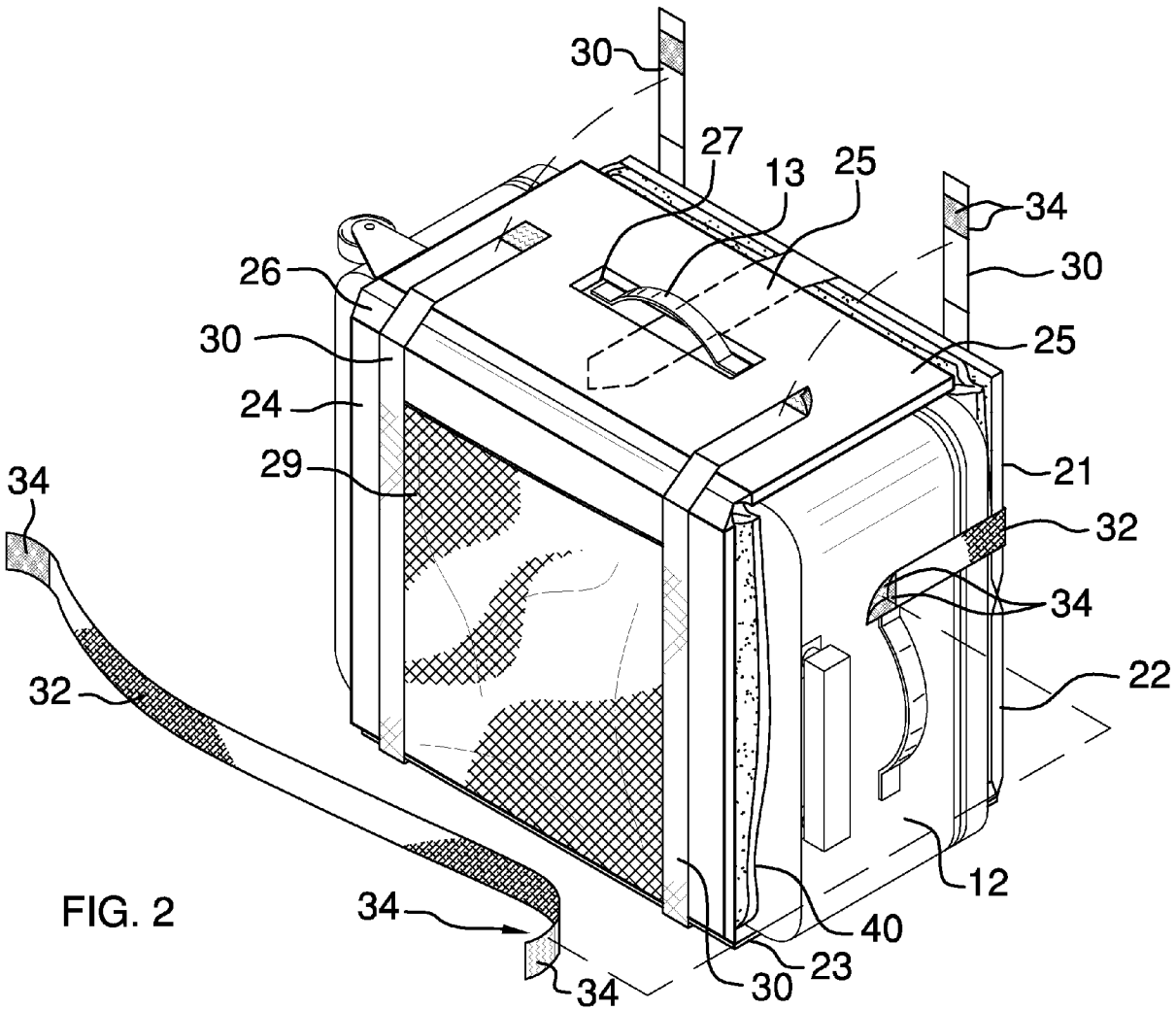
FIG. 2 is an in-use perspective view.

Referring to FIG. 2, the device 10 is removably wrapped around an existing luggage 12 with the rectangular slot 27 disposed about centrally within the flap section 25. The exterior pocket 29 is disposed on the fourth section 24.

Referring again to FIG. 1, the strap 28 is extended centrally and distally from the first section 21. The pair of spaced apart longitudinal straps 30 is disposed longitudinally on the mat 20. The longitudinal straps 30 are spaced apart from an each end of the slot 27. The longitudinal straps 30 are spaced inwardly from the first side 20A and the second side 20B. The longitudinal straps 30 extend partially onto the flap section 25. The longitudinal straps 30 extend beyond the first section 21.

Figure 2A:
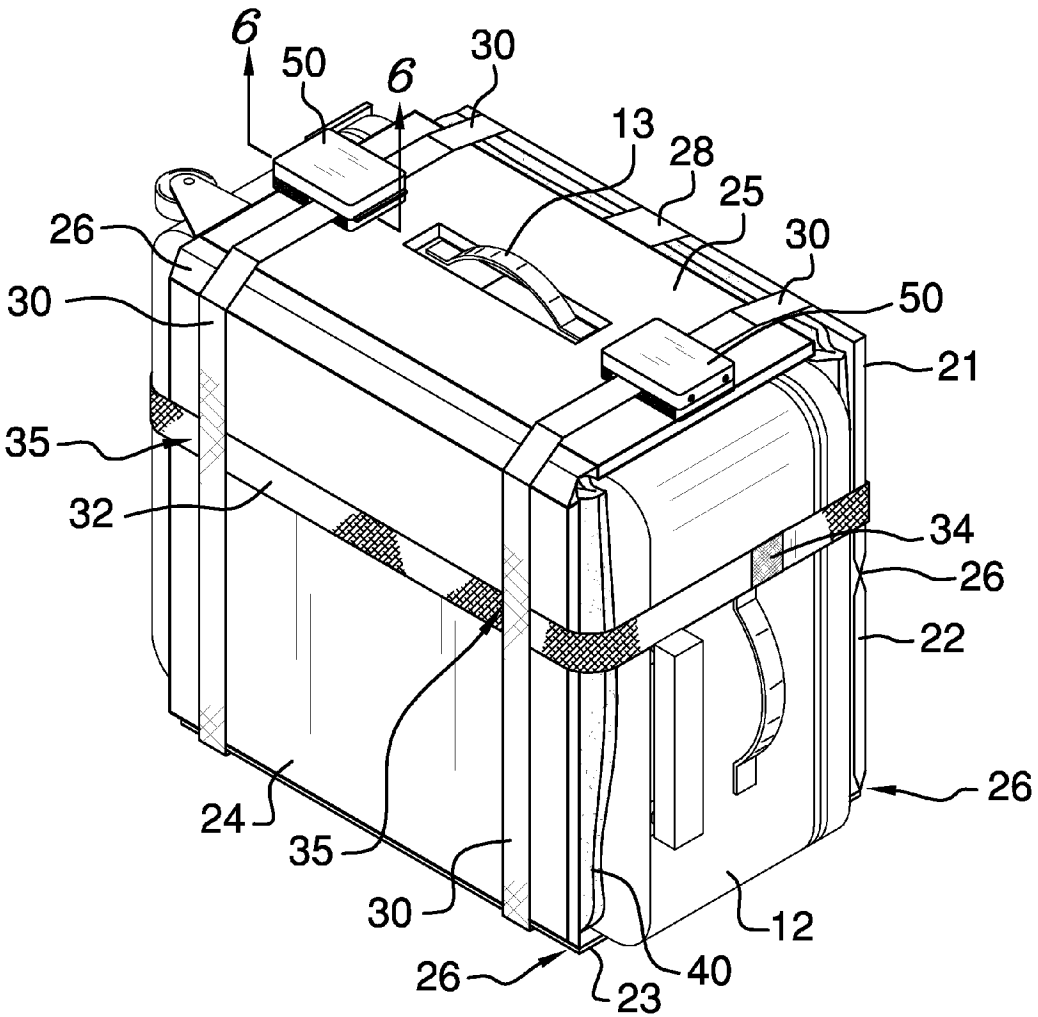
FIG. 2A is an in-use view with optional security mechanisms.

Referring again to FIG. 1 and also to FIG. 2A, the pair of lateral straps 32 is disposed laterally on the mat 20 and perpendicular to the longitudinal straps 30. One lateral strap 32 is disposed on the first section 21. One lateral strap 32 is disposed on the fourth section 24. An opening 35 is disposed within each longitudinal strap 30 on the fourth section 24. One of the lateral straps 32 is removably disposed within the openings 35 of the longitudinal straps 30.

Referring to FIG. 3 and again to FIG. 2, hook and loop 34 is disposed on each of the longitudinal straps 30. A hook portion is disposed on one end of each longitudinal strap while a loop portion is disposed on an opposite end of the longitudinal strap from the hook portion. The hook portion and the loop portion removably attach to each other, whereby the longitudinal straps 30 are removably fastened to themselves, no matter which end is on top of the other end.

Figure 3:
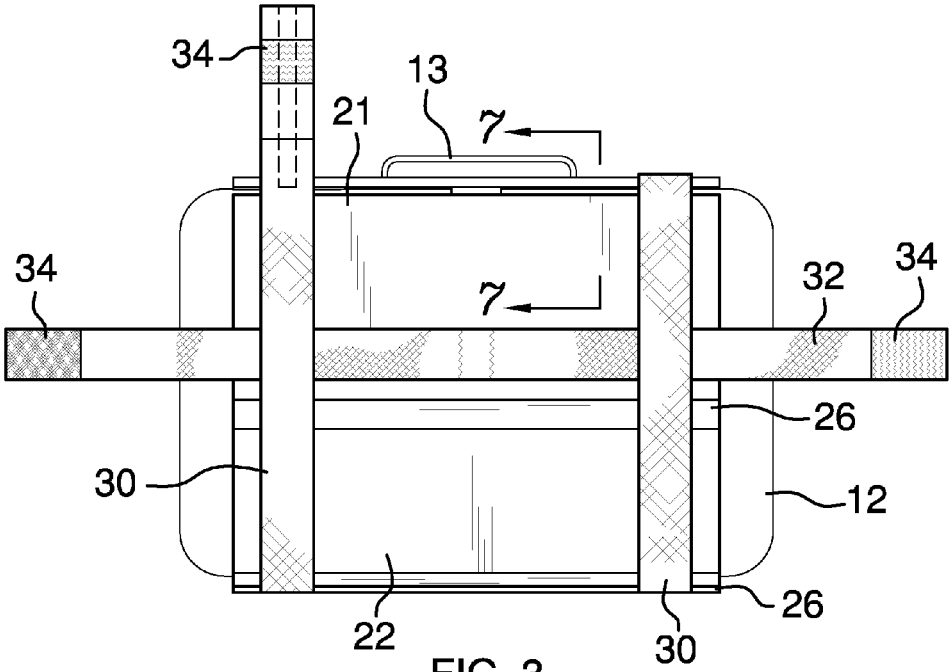
FIG. 3 is a front elevation view.
Figure 4:
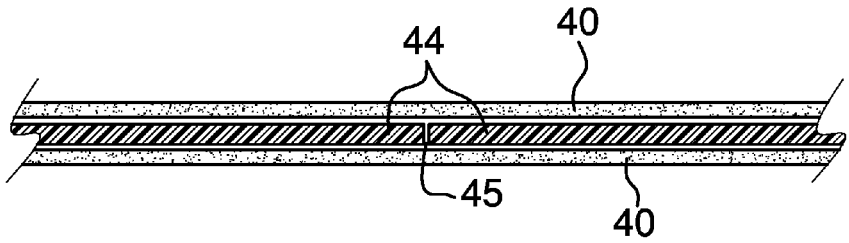
FIG. 4 is a partial cross sectional view of FIG. 1, taken along the line 4-4.

Referring to FIG. 3, hook and loop 34 is disposed on each of the lateral straps 32. A hook portion is disposed on one end of each longitudinal strap while a loop portion is disposed on an opposite end of the longitudinal strap from the hook portion. The hook portion and the loop portion removably attach to each other. The lateral straps 32 are thereby removably fastened to themselves, no matter which end overlaps which end.

Hook and loop 34 is disposed on each side of each mat 20 section.

Referring again to FIG. 1, the device 10 is partially comprised of the blanket 40. The blanket 40 has a blanket first side 40A spaced apart from a blanket second side 40B. The blanket center 40C is disposed between the blanket first side 40A and the blanket second side 40B.

Referring again to FIG. 1, the plurality of pliable hinges 26 is disposed within the blanket 40. The blanket 40 pliable hinges 26 correspond to the mat 20 pliable hinges 26. The plurality of hook and loop 34 is disposed on each side of the blanket 40. The blanket 40 hook and loop 34 corresponds with the mat 20 sections' hook and loop 34. The blanket 40 is thereby removably fastened on either the first side 20A or the second side 20B of the mat 20. The blanket 40 is selectively folded in the blanket center 40C such that the blanket first side 40A and the blanket second side 40B are selectively aligned with the mat 20 first side 20A and second side 20B. A V 43 is disposed from the blanket center 40C to the blanket first side 40A and the blanket second side 40B on one end of the blanket 40.

Referring again to FIG. 1, the blanket 40 further comprises a plurality of struts 44 disposed within the blanket first side 40A and second side 40B. Each strut 44 further comprises a joint 45. The strut 44 joints 45 allow the blanket 40 to be folded to smaller sizes while still providing reasonable blanket 40 rigidity when needed.

Figure 5:
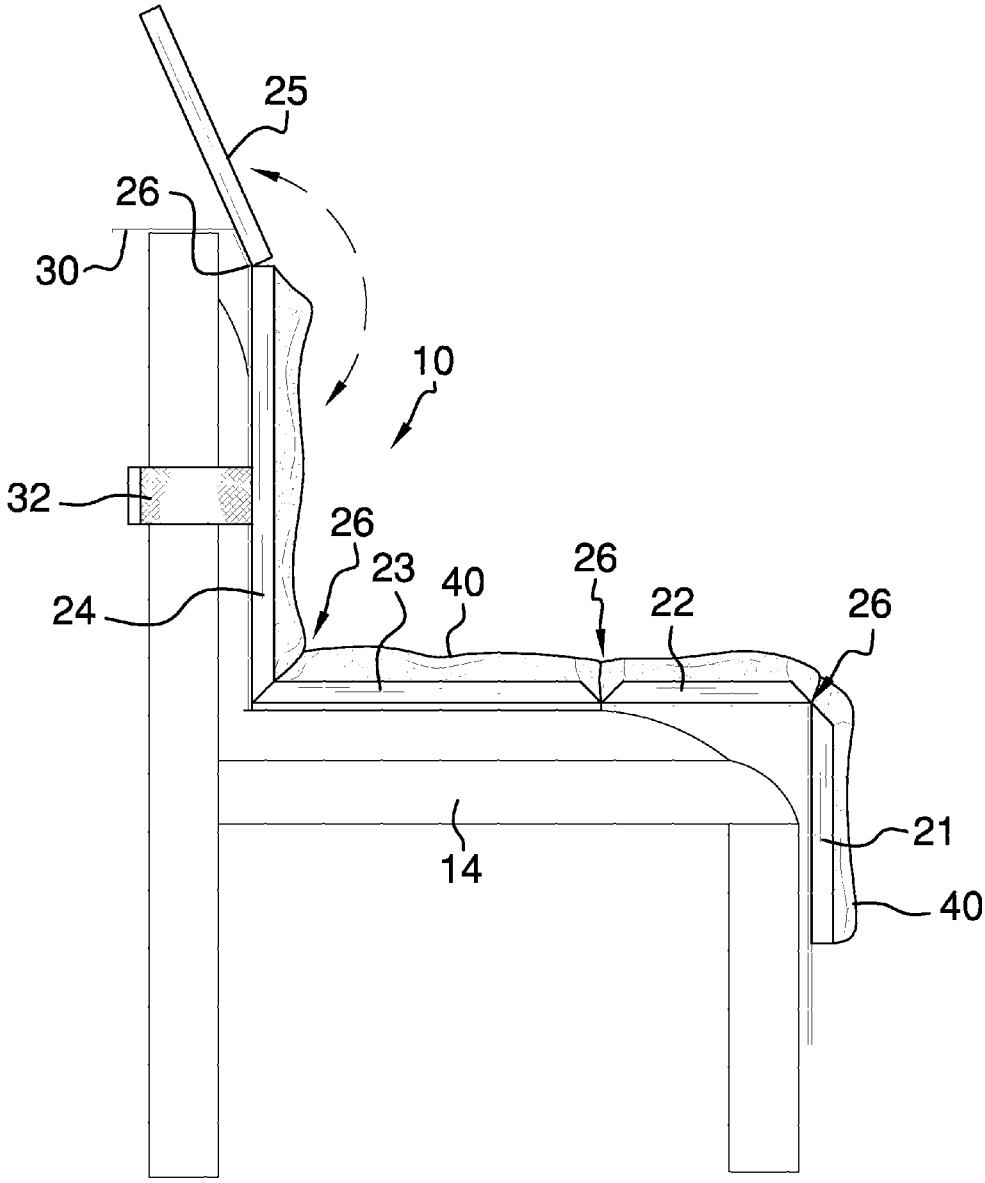
FIG. 5 is a lateral in-use view with seating.

Referring to FIG. 5, an exemplary use of the device 10 sees the mat 20 first section 21 and second section 22 folded about one of the pliable hinges 26 to fit around the chair 14 end and partially downward on the chair 14 legs. The third section 23 covers the chair 14 seat. The fourth section 24 fits the chair 14 back with one of the lateral straps 32 fastened via the hook and loop 34 around the chair 14 back to retain the device 10 to the chair 14. The flap section 25 is disposed upwardly from the chair 14 back and can aid as a headrest. Or, the flap section 25 can be disposed downwardly to aid as a backrest. The blanket 40 is affixed to the mat 20 to provide further comfort.

Figure 6:
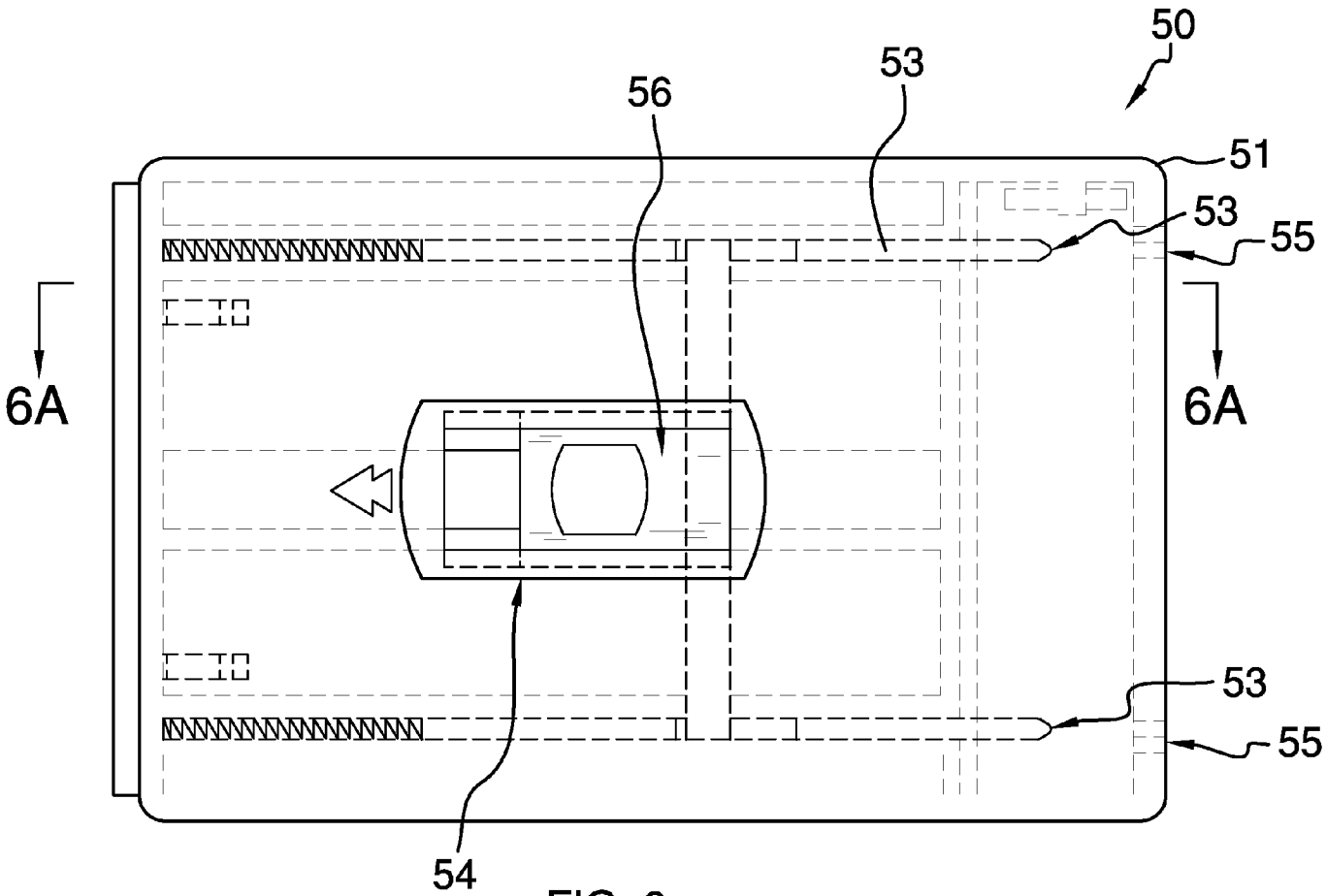
FIG. 6 is a bottom plan view of the latch mechanism.

Referring to FIG. 6, the optional security mechanism 50 is provided.

Figure 6A:
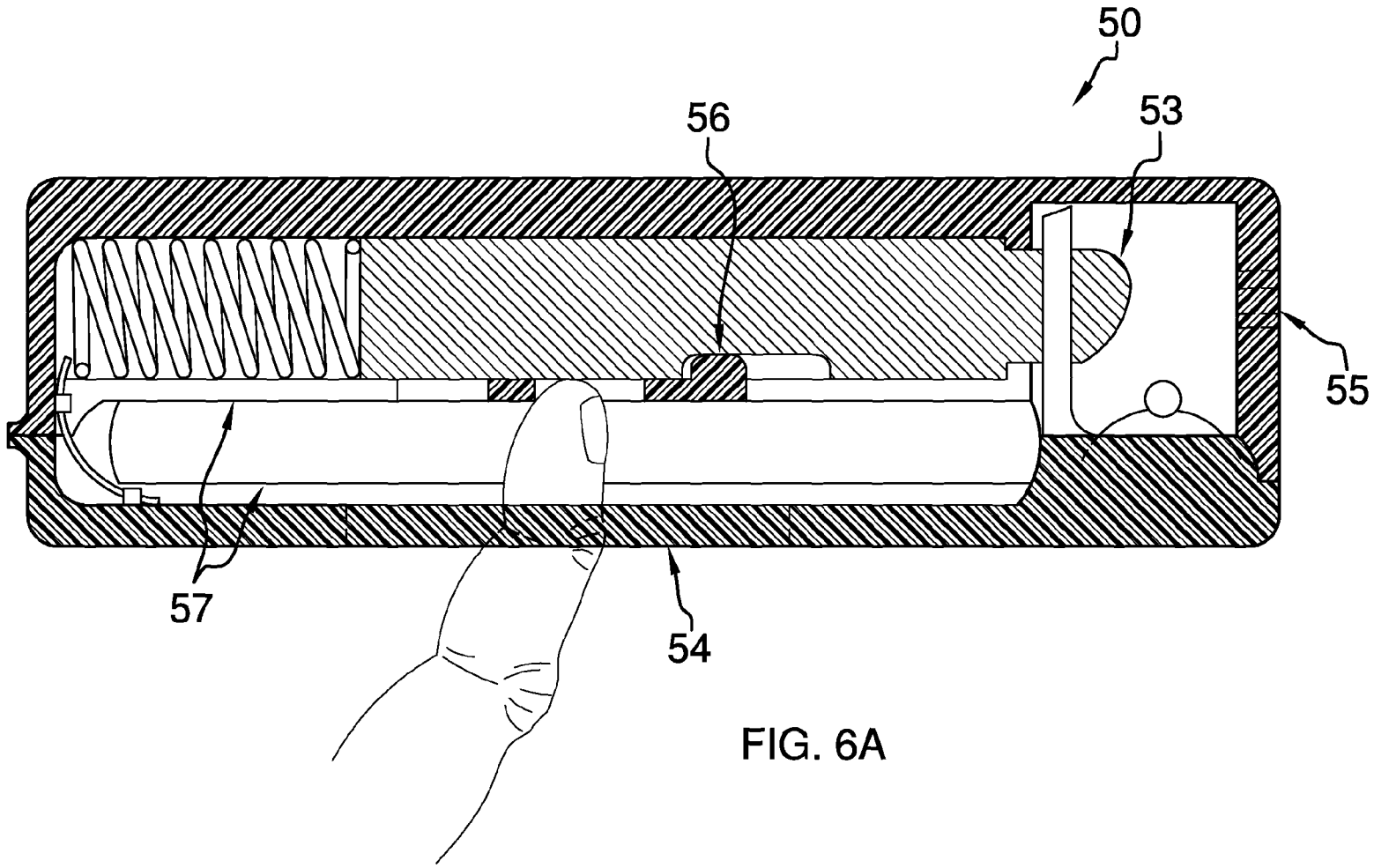
FIG. 6A is a cross sectional view of FIG. 2A, taken along the line 6A.

Referring to FIGS. 6 and 6A, the security mechanism 50 is opened for use by finger operation of the pull tab 56 opening the jaws 57. After insertion of the longitudinal straps 30 or lateral straps 32 within the jaws 57 of the security mechanism 50, the security mechanism 50 is snapped closed. This secures the device 10 to the luggage 12. To unlock the security mechanism 50 releasing the longitudinal straps 32, a key 51 with prongs 52 corresponding to the latching fingers 53 is placed over the security mechanism 50 and squeezed, thereby driving the prongs 552 through the keyholes 55 against the latching fingers 53 displacing them. This allows the security mechanism 50 to spring open. In the locked position the access opening 54 in the bottom of the security mechanism 50 is blocked by the longitudinal straps 30 or the lateral straps 32.

Figure 7:
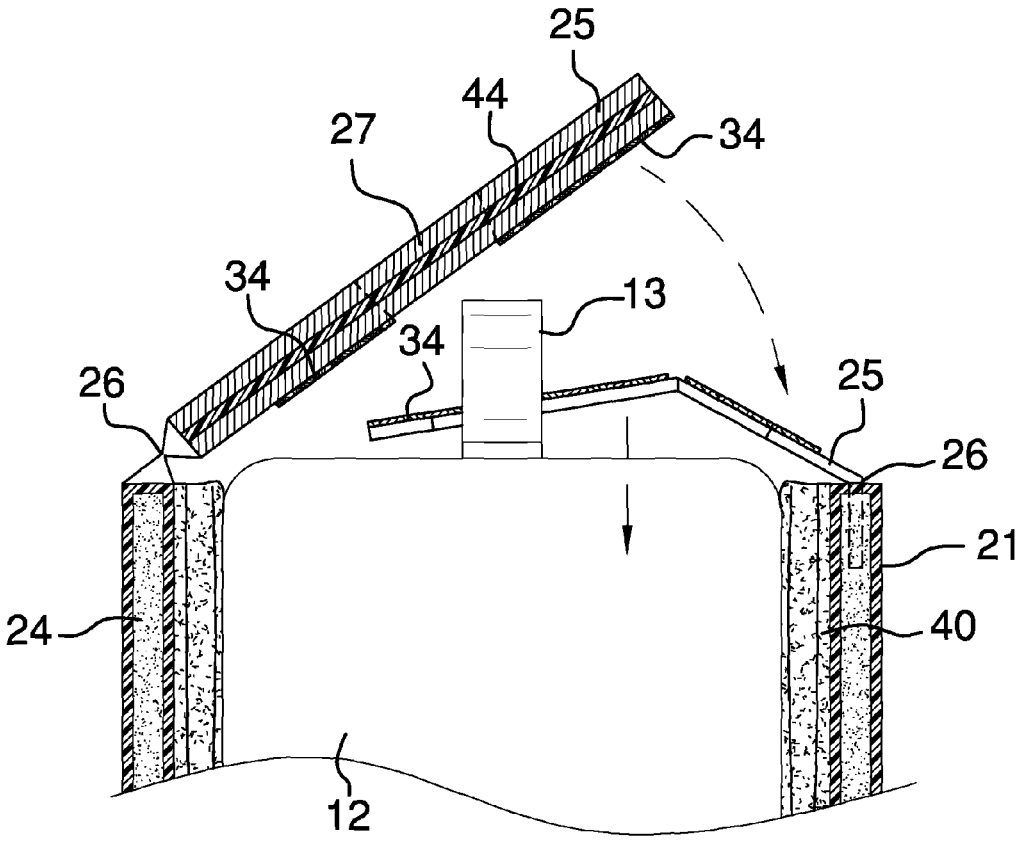
FIG. 7 is a partial cross sectional view of FIG. 3, taken along the line 7-7.

Referring to FIG. 7, the slot 27 of the flap section 25 allows for the flap section 25 to fit over the handle 13 of the existing luggage 12.

The hook and loop 34 of the flap section 25 and the strap 28 allow fastening of the device 10 to the luggage 12.

Continuing to refer to FIG. 7 and referring also to FIG. 2, the folded blanket 40 is tucked between the fourth section 24 and the luggage 12.

Figure 8:
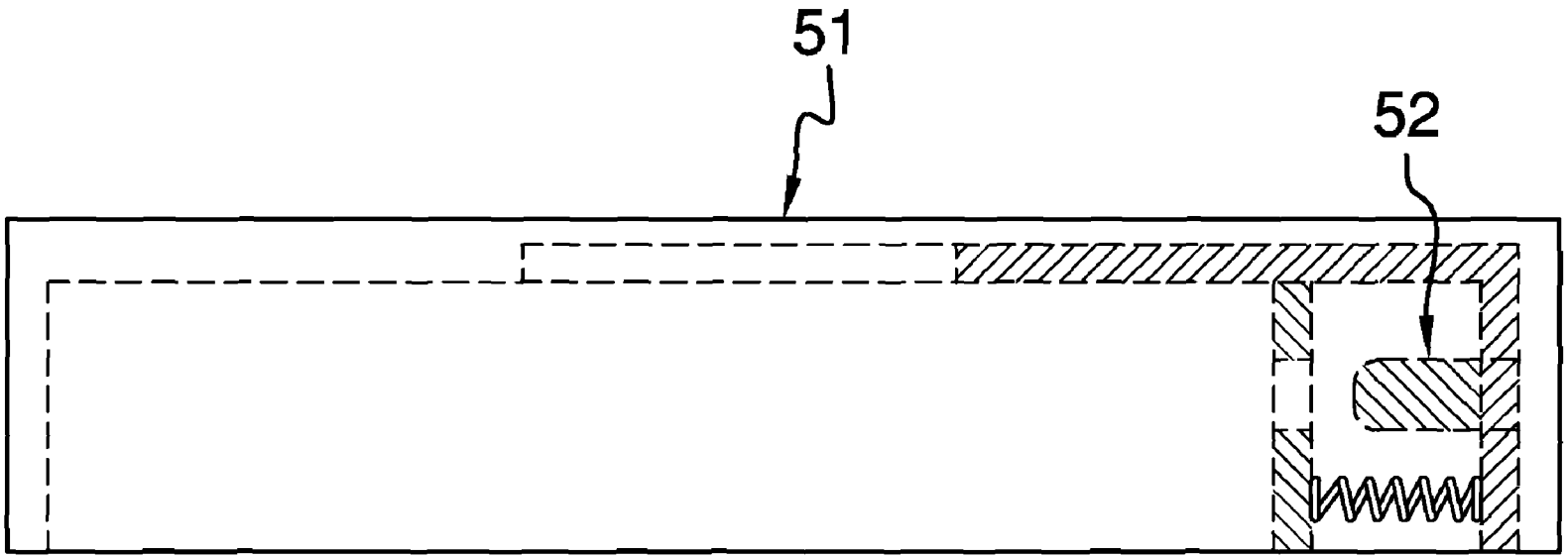
FIG. 8 is a cross sectional view of the security mechanism.

FIG. 8 provides a cross sectional view of the security mechanism 50.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the luggage attachable cushion device may be used.

What is claimed is:

1. A luggage attachable cushion device comprising, in combination:

a rectangular cushioned mat having a first side spaced apart from a second side, the mat comprising sequentially affixed rectangular sections joined by pliable hinges, the sections comprising a first section, a second section, a third section, a fourth section, and a flap section;

a rectangular slot dispose about centrally within the flap section;

a strap extended centrally and distally from the first section;

a pair of spaced apart longitudinal straps disposed longitudinally on the mat, the longitudinal straps space apart from an each end of the slot, the longitudinal straps spaced inwardly from the first side and the second side, the longitudinal straps extended partially onto the flap section, the longitudinal straps extended beyond the first section;

a pair of lateral straps disposed laterally on the mat and perpendicular to the longitudinal straps, one lateral strap disposed on the first section, one lateral strap disposed on the fourth section;

a hook and loop disposed on each of the longitudinal straps, wherein a hook portion is disposed on one end of each longitudinal strap and a loop portion is disposed on an opposite end of the longitudinal strap from the hook portion, wherein the hook portion and the loop portion removably attach to each other, whereby the longitudinal straps are removably fastened to themselves;

a hook and loop disposed on each of the lateral straps, wherein a hook portion is disposed on one end of each lateral strap and a loop portion is disposed on an opposite end of the lateral strap from the hook portion, wherein the hook portion and the loop portion removably attach to each other, whereby the lateral straps are removably fastened to themselves.

2. The device according to claim 1 further comprising an opening disposed within each longitudinal strap on the fourth section;

whereby the lateral strap on the fourth section is removably disposed.

3. The device according to claim 1 further comprising a plurality of struts disposed within the blanket second side.

4. The device according to claim 2 further comprising a plurality of struts disposed within the blanket second side.

5. The device according to claim 3 wherein each strut further comprises a joint.

6. The device according to claim 4 wherein each strut further comprises a joint.

7. A luggage attachable cushion device comprising, in combination:

a rectangular cushioned mat having a first side spaced apart from a second side, the mat comprising sequentially affixed rectangular sections joined by pliable hinges, the sections comprising a first section, a second section, a third section, a fourth section, and a flap section;

a pocket disposed exteriorly on the fourth section;

a rectangular slot dispose about centrally within the flap section;

a strap extended centrally and distally from the first section;

a pair of spaced apart longitudinal straps disposed longitudinally on the mat, the longitudinal straps space apart from an each end of the slot, the longitudinal straps spaced inwardly from the first side and the second side, the longitudinal straps extended partially onto the flap section, the longitudinal straps extended beyond the first section;

an opening disposed within each longitudinal strap and the fourth section;

a pair of lateral straps disposed laterally on the mat and perpendicular to the longitudinal straps, one lateral strap disposed on the first section, one lateral strap disposed on the fourth section, one of the lateral straps removably disposed within the openings of the longitudinal straps;

a hook and loop disposed on each of the longitudinal straps, wherein a hook portion is disposed on one end of each longitudinal strap and a loop portion is disposed on an opposite end of the longitudinal strap from the hook portion, wherein the hook portion and the loop portion removably attach to each other, whereby the longitudinal straps are removably fastened to themselves;

a hook and loop disposed on each of the lateral straps, wherein a hook portion is disposed on one end of each lateral strap and a loop portion is disposed on an opposite end of the lateral strap from the hook portion, wherein the hook portion and the loop portion removably attach to each other;

whereby the lateral straps are removably fastened to themselves;

a hook and loop disposed on each side of each mat section;

a blanket having a blanket first side spaced apart from a blanket second side, a blanket center disposed between the blanket first side and the blanket second side;

a plurality of pliable hinges disposed within the blanket, the blanket pliable hinges corresponding to the mat pliable hinges;

a plurality of hook and loop disposed on each side of the blanket, the blanket hook and loop corresponding with the mat section hook and loop, whereby the blanket is removably fastened on either the first side or the second side of the mat, the blanket selectively folded in the blanket center such that the blanket first side and the blanket second side are selectively aligned with the mat first side and second side.

8. The device according to claim 5 further comprising an opening disposed within each longitudinal strap on the fourth section;

whereby the lateral strap on the fourth section is removably disposed.

9. The device according to claim 7 further comprising a plurality of struts disposed within the blanket second side.

10. The device according to claim 8 further comprising a plurality of struts disposed within the blanket second side.

11. The device according to claim 9 wherein each strut further comprises a joint.

12. The device according to claim 10 wherein each strut further comprises a joint.

13. The device according to claim 8 further comprising a V disposed from the blanket center to the blanket first side and the blanket second side on a one end of the blanket.

14. The device according to claim 9 further comprising a V disposed from the blanket center to the blanket first side and the blanket second side on a one end of the blanket.

15. The device according to claim 10 further comprising a V disposed from the blanket center to the blanket first side and the blanket second side on a one end of the blanket.

16. The device according to claim 11 further comprising a V disposed from the blanket center to the blanket first side and the blanket second side on a one end of the blanket.

17. The device according to claim 12 further comprising a V disposed from the blanket center to the blanket first side and the blanket second side on a one end of the blanket.

* * * * *